US006112835A

United States Patent [19]

Grafe et al.

[11] Patent Number: 6,112,835

[45] Date of Patent: Sep. 5, 2000

[54] DRILLING APPARATUS HAVING A RADIALLY DISPLACEABLE REAMER

[75] Inventors: Edward F. Grafe, Waxahachie; James A. Mantooth; John M. Kolker, both of Arlington, all of Tex.

[73] Assignee: Sandvik AB, Sandviken, Sweden

[21] Appl. No.: 09/121,189

[22] Filed: Jul. 23, 1998

[51] Int. Cl.[7] ..... E21B 10/66; E21B 10/32

[52] U.S. Cl. ..... 175/258; 175/292; 175/385

[58] Field of Search ..... 175/257, 258, 175/292, 385, 389, 399, 415, 406, 390

[56] References Cited

U.S. PATENT DOCUMENTS

| | | | |
|---|---|---|---|
| 4,281,722 | 8/1981 | Tucker et al. | 175/57 |
| 4,408,669 | 10/1983 | Wiredal | 175/258 |
| 4,440,244 | 4/1984 | Wiredal | 175/292 |
| 4,770,259 | 9/1988 | Jansson . | |
| 5,009,274 | 4/1991 | Löf | 175/206 |
| 5,052,503 | 10/1991 | Löf | 175/258 |
| 5,186,265 | 2/1993 | Henson et al. | 175/107 |
| 5,975,222 | 11/1999 | Holte | 175/273 |

FOREIGN PATENT DOCUMENTS 2 312 700 11/1997 United Kingdom .

*Primary Examiner*—Frank Tsay

*Attorney, Agent, or Firm*—Burns, Doane, Swecker & Mathis, L.L.P.

[57] ABSTRACT

A drilling tool for boring in earth and rock formations includes a pilot bit which defines a longitudinal tool axis and includes a cam part having a cam axis arranged eccentrically relative to the tool axis. A reamer includes a hollow reamer body mounted on the cam part for rotation relative thereto about the cam axis. Relative rotation in one direction causes the reamer to be radially extended, and relative rotation in an opposite direction causes the reamer to be radially retracted. The reamer body carries cutting elements for enlarging a hole drilled by the pilot bit when the reamer is in its extended position. The cam part carries a first removable insert on which a first stop surface is formed. The reamer carries a second removable insert on which a second stop surface is formed. The stop surfaces are engageable with one another when the reamer body is radially extended, for transmitting rotational cutting forces to the reamer. The stop surfaces are formed of a material harder than a material from which the cam part and the reamer body are formed. The stop surface of the insert carried by the reamer may be formed by a plurality of rotary ball bearings.

28 Claims, 5 Drawing Sheets

FIG. 1
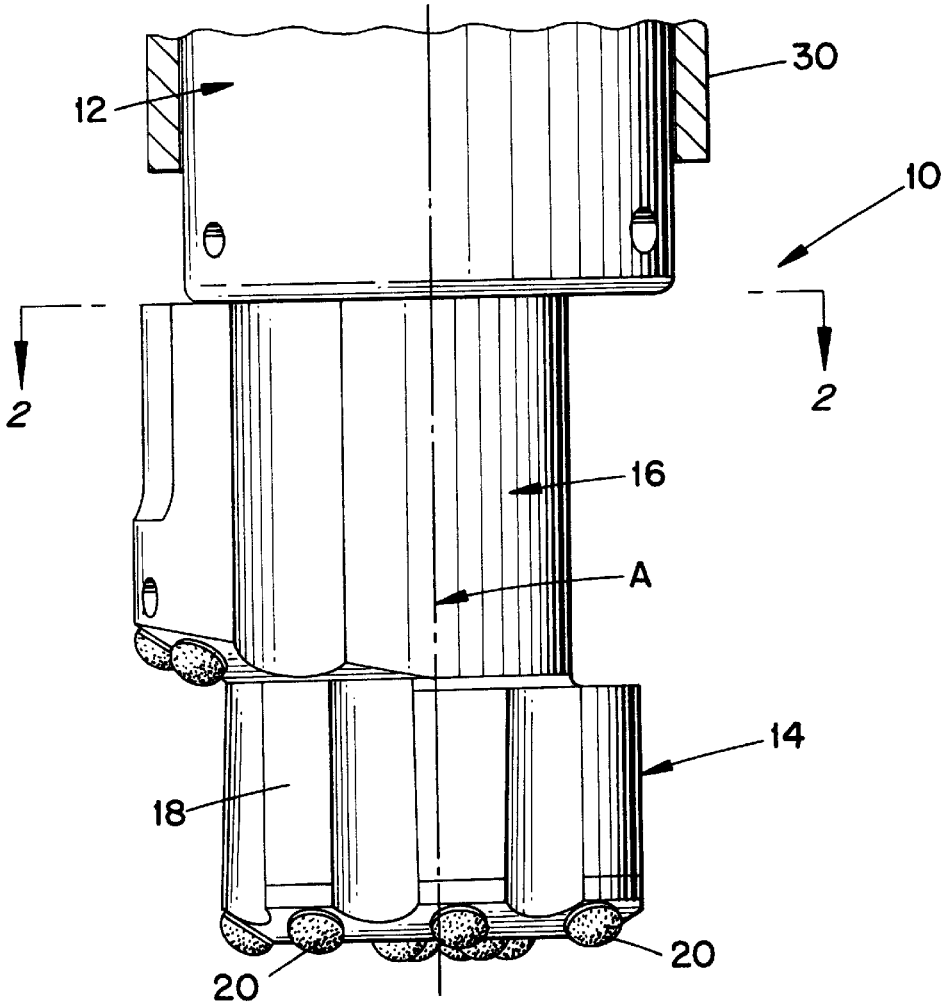
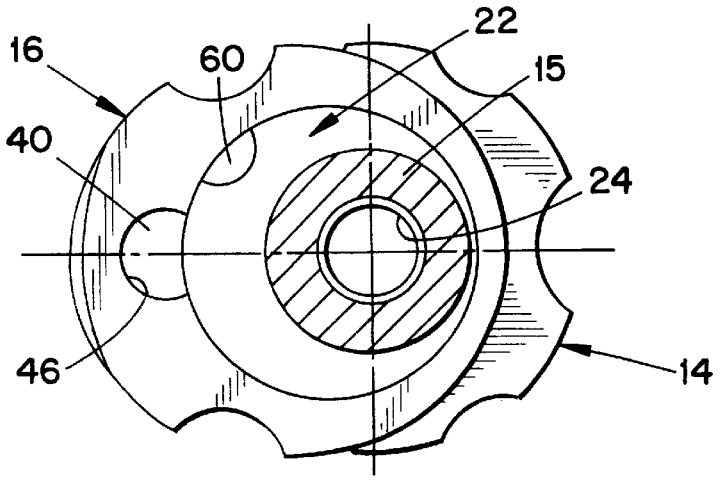
FIG. 2

FIG. 3
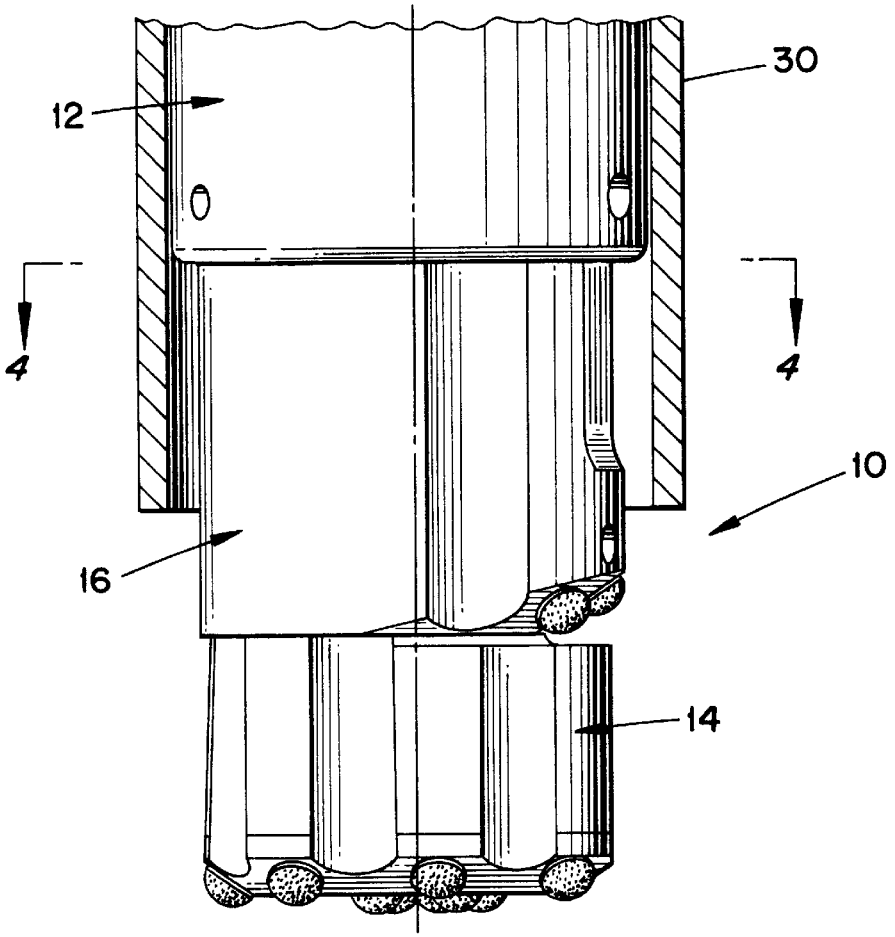
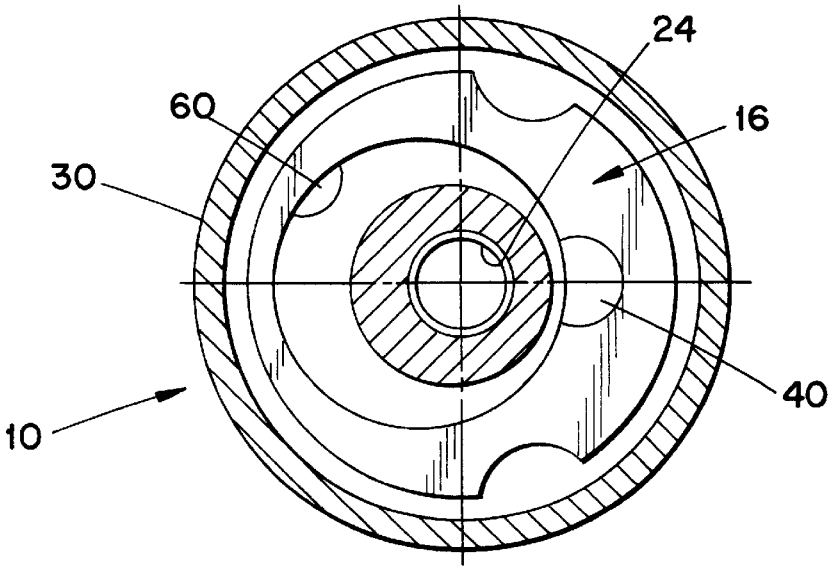
FIG. 4

FIG. 5
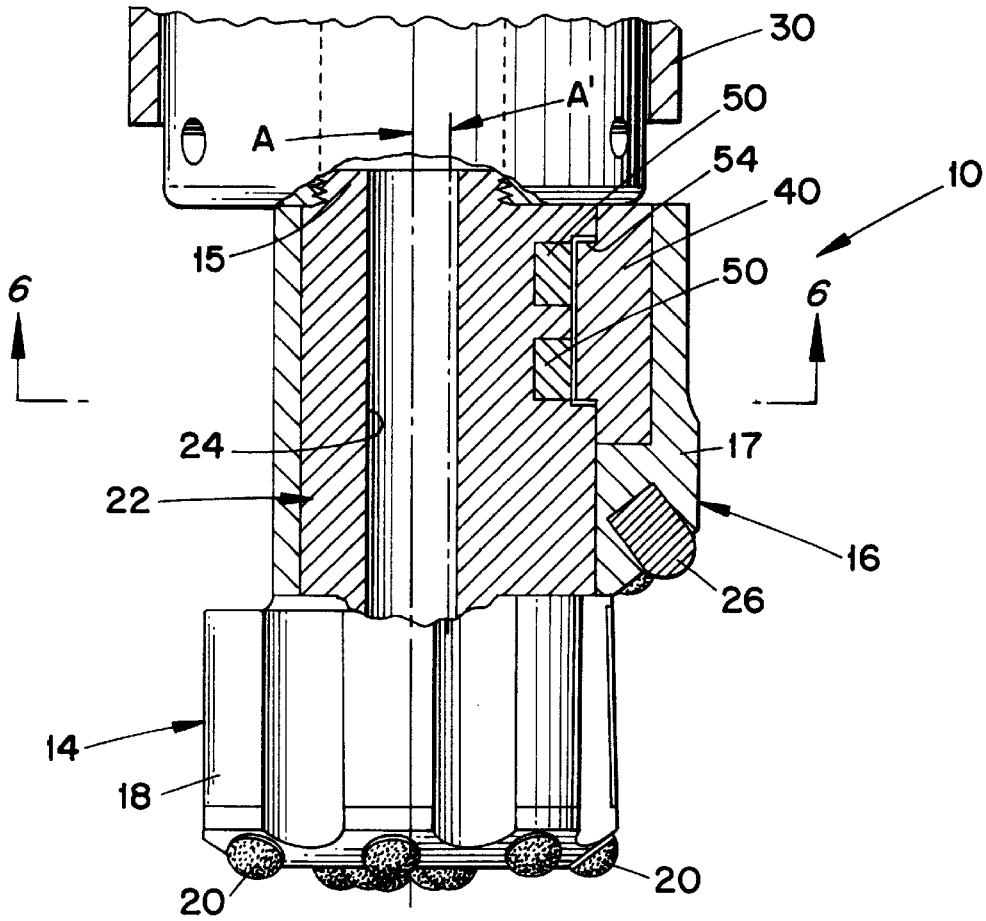
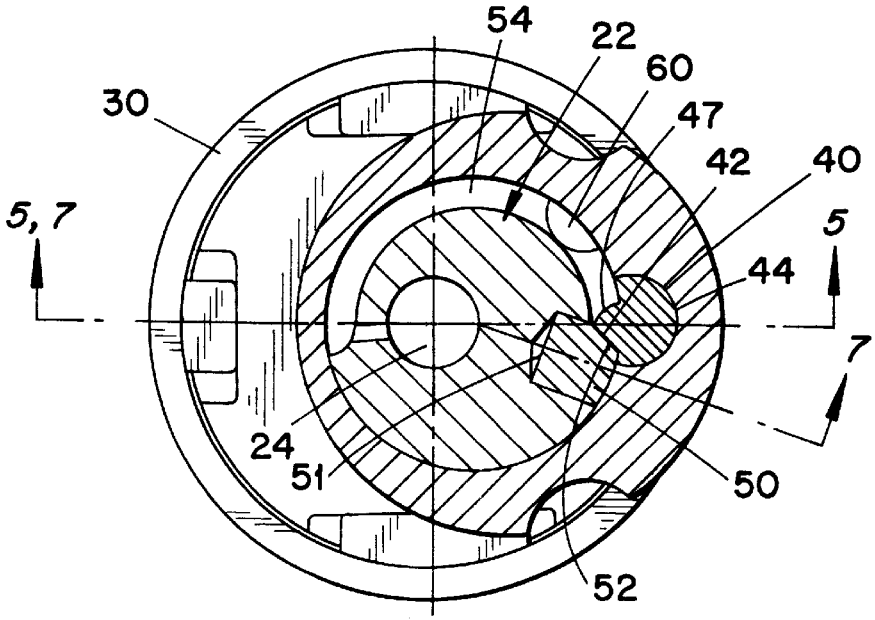
FIG. 6

FIG. 8
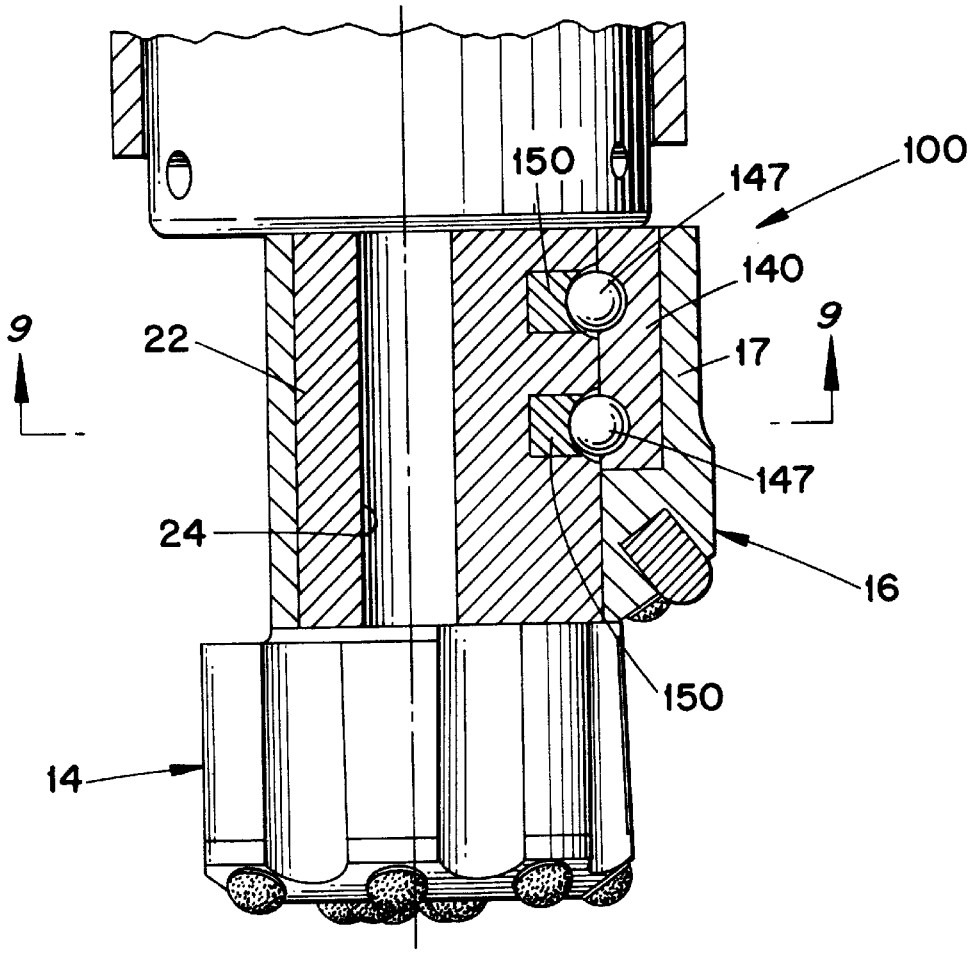
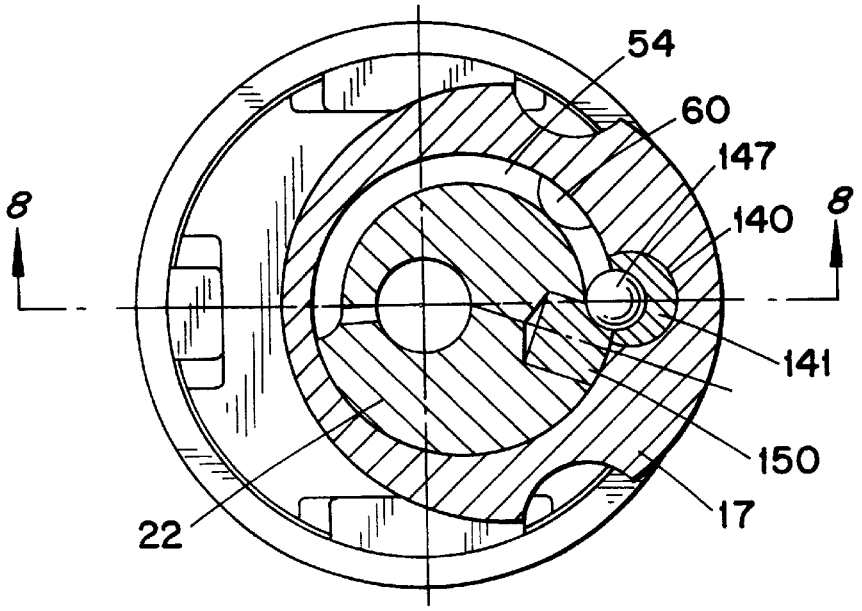
FIG. 9

DRILLING APPARATUS HAVING A RADIALLY DISPLACEABLE REAMER

BACKGROUND OF THE INVENTION

The present invention relates to percussive and/or rotary drill tools having a pilot bit, and an eccentric reamer mounted on the pilot bit for radial extension and retraction.

Such a drill tool is described in jansson U.S. Pat. No. 4,770,259 wherein a pilot bit includes a lower drill head that is coaxial with the tool axis, and an upper threaded stem which screws into the bottom end of a guide device. The guide device is adapted to be mounted at the lower end of a drill string for rotation therewith. The pilot bit also includes an eccentric cam part situated above the drill head. In a percussive-type tool, the apparatus can be subjected to percussive impacts by a top-hole percussion mechanism, or a down-the-hole percussion mechanism, during an earth or rock boring operation.

Mounted on the eccentric cam part is a hollow reamer which is rotatable relative to the cam part, whereby relative rotation in one direction causes the reamer to be extended radially outwardly to drill a hole larger than the tool, in order to enable a hole casing to be brought down with the tool. In response to relative rotation in the opposite direction, the reamer is retracted radially inwardly to a small enough diameter to enable the tool to be withdrawn upwardly through the hole casing.

In order to stop the relative rotation at the end of a reamer-displacement operation, to retain the reamer in its extended or retracted state, the cam part and the reamer are provided with respective stop surfaces facing in opposing circumferential directions. The stop face is formed integrally on the cam part by a radially outwardly projecting lug disposed to rotate within an arc-shaped recess formed in the inner periphery of the reamer.

During a boring operation, with the reamer in an extended state, the stop surfaces of the cam part and reamer transmit the rotational cutting forces to the reamer. As a result, the surfaces are particularly susceptible to wear. When the surfaces become excessively worn, the tool must be pulled to replace the worn parts, which is costly in terms of materials and lost drilling time.

Another shortcoming involves the fact that appreciable clearances should be provided between the lug and the adjacent surfaces of the recess in which the lug moves, in order to reduce the frictional resistance to relative rotation between the cam part and the reamer. However, cuttings and other foreign matter are able to penetrate such large clearances, thereby accelerating the abrasive wearing of the surfaces.

Another drill of this general type is disclosed in British Published Application No. 2,312,700 wherein the cam part of the pilot bit carries a pin insert that projects axially forwardly and is movably received in an upwardly open, semi-annular groove formed in the reamer. The pin limits the extent of relative rotation between the cam part and the reamer by abutting the ends of the groove and also transmits rotational cutting force to the reamer. This drill is thus susceptible to wear for the same reasons as described earlier. The drill disclosed in the British application facilitates relative rotation between the cam part and the reamer by positioning a horizontal annular row of ball bearings within cooperative grooves formed in the cam part and the reamer. However, such an arrangement may permit the reamer to become cocked or skewed relative to the reamer (i.e., the axis of the reamer can become disposed non-parallel with respect to the axis of the cam part).

It would be desirable to provide an improved drilling apparatus which eliminates the above-discussed shortcomings.

SUMMARY OF THE INVENTION

One aspect of the present invention relates to a drilling apparatus for boring in earth and rock formations. The drilling apparatus comprises a pilot bit defining a longitudinal tool axis and including a cam part having a cam axis arranged eccentrically relative to the tool axis. A reamer includes a hollow reamer body mounted on the cam part for rotation relative thereto about the cam axis, whereby relative rotation in one direction causes the reamer to be radially extended, and relative rotation in an opposite direction causes the reamer to be radially retracted. The reamer body carries cutting elements for enlarging a hole drilled by the pilot bit when the reamer is in its extended position. First and second stop surfaces are disposed on the cam part and the reamer body, respectively and are engageable with one another when the reamer body is radially extended, for transmitting rotational cutting forces to the reamer body during a boring operation. The first and second stop surfaces are disposed on first and second removable inserts that are removably mounted on the cam part and the reamer body, respectively. Those stop surfaces are formed of a material harder than a material from which the cam part and the reamer body are formed, and thus are more resistant to wear.

Other aspects of the invention relate to the reamer and the pilot bit, per se.

A further aspect of the invention relates to a drilling apparatus for boring in earth and rock formations comprising a pilot bit defining a longitudinal tool axis and including a cam part having a cam axis arranged eccentrically relative to the tool axis. A reamer includes a hollow reamer body mounted on the cam part for rotation relative thereto about the cam axis, whereby relative rotation in one direction causes the reamer to be radially extended, and relative rotation in an opposite direction causes the reamer to be radially retracted. The reamer body carries cutting elements for enlarging a hole drilled by the pilot bit when the reamer is in its extended position. Either the cam part or the reamer body includes a removable insert including an insert body and a rotatable bearing element mounted rotatably on the insert body. The other of the cam part and the reamer includes an arcuate groove in which the bearing element projects. Preferably, there is a plurality of the rotatable bearing elements, including vertically spaced bearing elements for resisting skewing of the reamer.

BRIEF DESCRIPTION OF THE DRAWINGS

The objects and advantages of the invention will become apparent from the following detailed description of preferred embodiments thereof in connection with the accompanying drawings in which like numerals designate like elements and in which:

FIG. 1 is a side elevational view of a drilling apparatus according to the present invention, with a reamer portion thereof disposed in a radially extended position;

FIG. 2 is a cross-sectional view taken along the line 2—2 in FIG. 1;

FIG. 3 is a view similar to FIG. 2, with the reamer portion disposed in a radially retracted position;

FIG. 4 is a cross-sectional view taken along the line 4—4 in FIG. 3;

FIG. 5 is a side elevational view, partly in longitudinal section, of the drilling tool depicted in FIG. 1, with the reamer portion disposed in a radially extended position, wherein the axially sectioned portion of the FIG. 5 is taken along the line 5—5 in FIG. 6;

FIG. 6 is a cross-sectional view taken along the line 6—6 in FIG. 5;

FIG. 8 is a view similar to FIG. 5 of a second preferred embodiment according to the invention, with an axially sectioned portion of FIG. 8 being taken along the line 8—8 in FIG. 9; and FIG. 9 is a cross-sectional view taken along the line 9—9 in FIG. 8.

DETAILED DESCRIPTION OF PREFERRED EMBODIMENTS OF THE INVENTION

Figure 7:
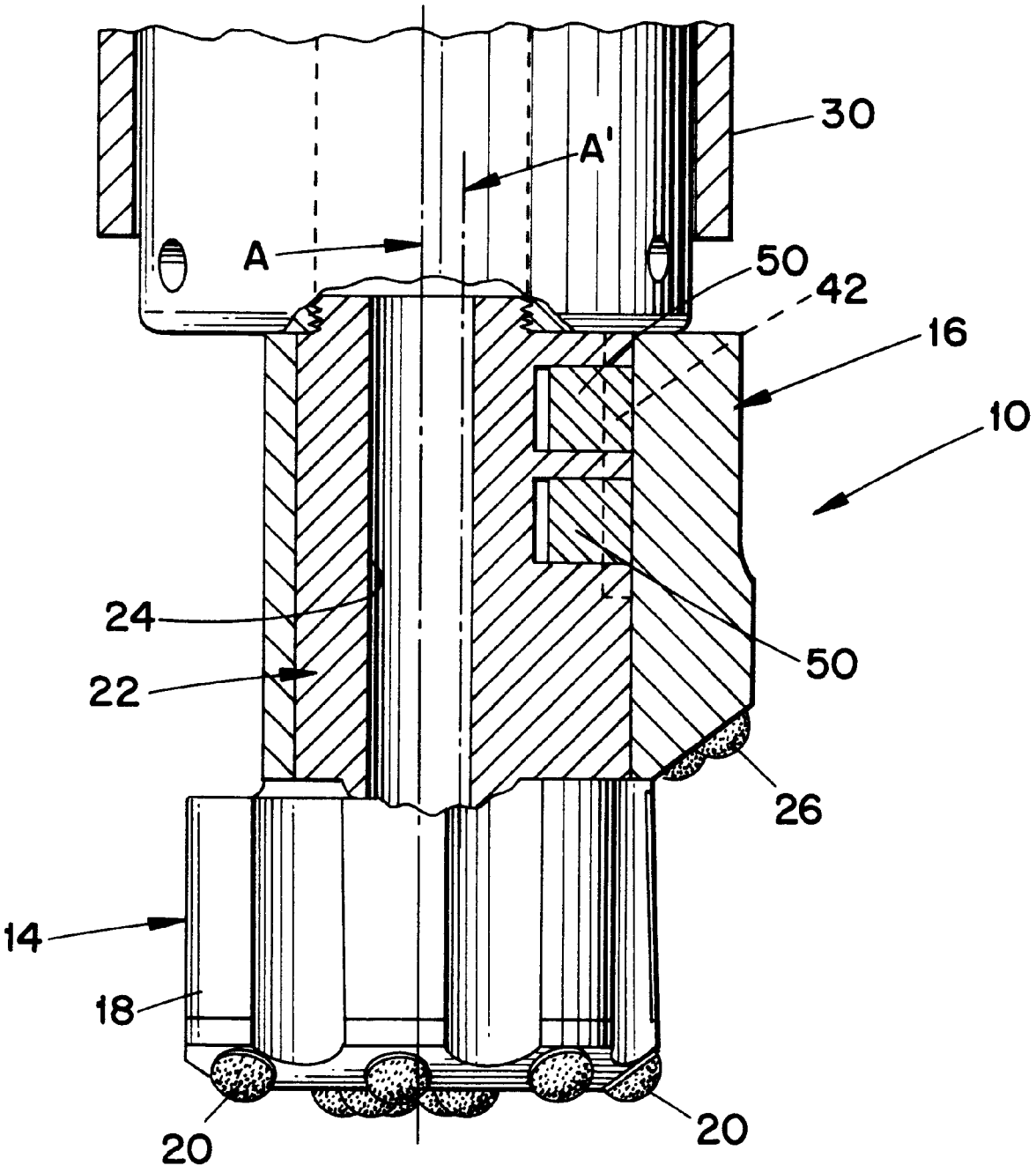
FIG. 7 is a view similar to FIG. 5, wherein the axially sectioned portion thereof is taken along the line 7—7 in FIG. 6.

Depicted in FIG. 1 is a drilling apparatus 10 adapted to be mounted on a drill string (not shown) of a drill tool for use in earth and rock boring operations. The drill tool can be of the percussive or rotary type.

The drilling apparatus 10 includes: a guide device 12 adapted to be connected to a front or lower end of a percussive hammer or drill string, a pilot bit 14 having an upper or rear stem 15 that screws into a lower or front end of the guide device 12 (see FIG. 5), and an eccentric reamer 16 mounted on the pilot bit 14 for radial extension and retraction.

The pilot bit 14 includes a lower drill head 18 having cutting elements 20, and a cam part 22 disposed above or behind the drill head. The cam part is situated eccentrically relative to the drill head 18. That is, the cam part 22 defines a vertical axis A' which is offset horizontally from a vertical axis A defined by the drill head 14.

Extending vertically through the center of the pilot bit 14 is a fluid channel 24 for conducting fluid such as air for cooling and flushing the lower end of the drill head and removing cuttings from the bored hole.

The reamer 16 includes a hollow body 17 mounted on the cam part 22 for limited rotation relative thereto about the eccentric axis A'. Cutting elements 26 are mounted on a lower face of the reamer body 17 for radially enlarging the hole when the reamer is in a radially extended position (see FIGS. 1, 2, 5 and 6). That hole drilled by the reamer is of larger diameter than the one drilled by the pilot bit 14, to enable a hole casing 30 to be brought down during the boring operations, e.g., when overburden conditions are encountered.

The reamer 16 is movable to a radially retracted position (see FIGS. 3 and 4) to enable the reamer to be withdrawn vertically through the hole casing 30 along with the drill string, the guide device 12, and the pilot bit 14.

Displacement of the reamer 16 between the radially extended and retracted positions is achieved by producing relative rotation between the pilot bit 14 and the reamer 16. That will result in rotation of the cam part 22 within the reamer 16, causing the reamer to be pushed radially outwardly or pulled radially inwardly, depending upon the direction of relative rotation between the reamer and the cam part.

It is desirable to define limits for the relative rotation in each direction, in order to precisely establish the radial extended and retracted positions of the reamer. Establishing the reamer extended position is accomplished by the provision of an insert 40 mounted in the reamer, and one or more inserts 50 (two being shown) mounted in the cam part 22. The insert 40 forms a circumferentially facing stop face 42 positioned to be abutted by circumferentially facing stop faces 52 of the respective inserts 50. The inserts 40, 50, the reamer body 17, and the cam part 22 can be formed of hardened steel alloys, for example. Importantly, however, the material of the inserts 40, 50 (and thus of the stop faces 42, 52) is harder than the material of the reamer body 17 and the cam part 22, and the stop faces 42, 52 are positioned to abut one another when the reamer is in a radially extended position. Thus, as the reamer 16 is being driven in a cutting mode, the rotary cutting forces are transmitted between two hard surfaces which are more wear-resistant than the materials from which the reamer body 17 and cam part 22 are formed.

The inserts 50 are disclosed as comprising a pair of vertically spaced cylindrical pins. However, more or less than two pins could be employed, or the insert could be of different shape, e.g., a single vertically elongated insert similar to the insert 40. The pins 50 are mounted in correspondingly shaped radial holes 51 formed in the outer periphery of the cam part.

The insert 40 includes a cylindrical outer surface 44 supported in a correspondingly shaped, upwardly open recess 46 in the reamer. The stop surface 42 is formed on a projection 47 of the insert 40, the projection being positioned for movement in a radially outwardly open, circumferentially extending groove 54 formed in an outer periphery of the cam part 22 (see FIG. 5). The projection transforms into an integral insert portion of expended cross section within the recess 46 as can be seen in FIG. 6. The inserts 50 are positioned at a circumferential end of the groove 54, i.e., the end thereof which approaches the insert 40 as the reamer is being radially extended.

The recess 46 is open at the top of the reamer body 17 to enable the insert 40 to be inserted downwardly therein. The cam part 22 includes a recess 60 formed in its outer periphery. That recess 60 extends axially from the top of the cam part and communicates with the arcuate groove 54. Thus, when the recess 60 mates with, i.e., is situated radially opposite the recess 46, downward axial movement of the projection 42 is accommodated when the insert 40 is being installed. Once the insert 40 has been installed in the reamer, and the reamer has been installed between the cutting head 18 and the guide device 12, axial dislodgement of the insert 40 and radial dislodgement of the inserts 50 is prevented. Thus, the inserts 40 and 50 can be loosely mounted in their respective recesses.

To assemble the apparatus 10, the inserts 50 are inserted radially into the respective holes 51 of the cam part 22, and the insert 40 is inserted vertically downwardly into the recess 46. Alternatively, the insert 40 could also be designed to be inserted in a radial direction. The reamer 16 is then mounted on the pilot bit 14 by being inserted axially over the cam part 22, with the pilot bit oriented such that the recess 60 of the cam part is disposed radially opposite the recess 46 of the reamer, in order to accommodate axial movement of the projection 42 of the insert 40. Thereafter, the projection 42 will be situated within the arcuate groove 54 of the cam part 22. The guide device 12 is then screwed onto the stem 15 of the pilot bit 14.

To perform an earth or rock boring operation in which the hole casing 30 is being brought down with the drill string, the drill string is rotated in a first direction, i.e., counterclockwise when viewed in FIG. 6, whereby the cam part 22 rotates counterclockwise relative to the reamer 16. That relative movement, which causes the reamer to be radially extended, takes place until the stop surfaces 52 of the inserts 50 abut the stop surface 42 of the insert 40. Continued counterclockwise rotation of the drill string causes the reamer to be rotated counterclockwise to bore a hole larger than the diameter of the hole casing 30. The rotary drive forces are transmitted through the stop surfaces 52, 42 which, due to their high hardness, are very resistant to wear. Accordingly, the life spans of the reamer and pilot drill are increased.

In another preferred embodiment of the invention, a drilling apparatus 100, depicted in FIGS. 8 and 9, has an insert 140 mounted in the reamer, the insert including a body 141 which carries a pair of vertically spaced, hardened rotary bearing elements, preferably ball bearings 147. Those ball bearings constitute projections which form stop surfaces.

Two hardened stop pins 150 carried by the cam part 22 have respective spherically concave stop surfaces for engaging the spherical outer surfaces of respective ones of the hardened ball bearings 147.

During rotation of the cam part relative to the reamer during reamer-extension and reamer-retraction steps, the ball bearings 147 roll within the groove 54 of the cam part, thereby facilitating the relative rotation.

Consequently, the size of clearances formed between the relatively movable parts can be minimized, thereby resisting the entry of abrasive particles between those parts. Also, since the ball bearings are vertically spaced, they will be able to resist cocking or skewing of the reamer relative to the cam part, as compared with the prior art use of a single row of ball bearings all disposed in a horizontal plane wherein skewing is possible.

The ball bearings, the insert body 41, and the pins 150 are formed of a harder material than the cam part and reamer body, so that when the reamer is performing a cutting operation, the rotational cutting forces are transmitted by hard, wear-resistant surfaces formed by the pins 150 and the ball bearings 147.

Although the cam part and reamer have been disclosed such that the groove 54 is disposed in the cam part, and the projection 47 or 147 disposed in the reamer, a reverse arrangement is possible, i.e., wherein the groove is disposed in the inner periphery of the reamer, and the projection disposed in the cam part.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drilling apparatus for boring in earth and rock formations, comprising:

a pilot bit defining a longitudinal tool axis and including a cam part having a cam axis arranged eccentrically relative to the tool axis;

a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position; and first and second stop surfaces disposed on the cam part and the reamer body, respectively, and engageable with one another when the reamer body is radially extended, for transmitting rotational cutting forces to the reamer body during a boring operation;

the first and second stop surfaces disposed on respective first and second removable inserts that are removably mounted on the cam part and the reamer body, respectively, the first and second stop surfaces being formed of a material harder than a material from which the cam part and the reamer body are formed;

wherein the pilot bit includes a drill head rigid with a lower end of the cam part, the reamer disposed above the drill head and being rotatable relative thereto.

2. The apparatus according to claim 1 wherein one of the first and second inserts includes a radial projection forming one of the stop surfaces.

3. The apparatus according to claim 2 wherein the projection comprises a rotatable bearing element.

4. The apparatus according to claim 3 wherein the rotatable bearing element is disposed on the second insert.

5. The apparatus according to claim 4 wherein the rotatable bearing element comprises a ball bearing.

6. The apparatus according to claim 2 wherein the projection is disposed on the second insert.

7. The apparatus according to claim 2 wherein the second insert comprises an insert body, and the projection is rigid with the insert body.

8. A drilling apparatus for boring in earth and rock formations, comprising:

a pilot bit defining a longitudinal tool axis and including a cam part having a cam axis arranged eccentrically relative to the tool axis; and a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position;

one of the cam part and the reamer body including a removable insert including an insert body and a rotatable bearing element mounted rotatably on the insert body, the other of the cam part and the reamer including an arcuate groove in which the bearing element projects.

9. The apparatus according to claim 8 wherein there is a plurality of the rotatable bearing elements mounted on the insert body.

10. The apparatus according to claim 9 wherein the plurality of bearing elements includes vertically spaced-apart bearing elements.

11. The apparatus according to claim 10 wherein the other of the cam part and the reamer includes vertically spaced arcuate grooves for receiving respective ones of the vertically spaced rotatable bearing elements.

12. The apparatus according to claim 8 wherein the rotatable bearing element comprises a ball bearing.

13. The apparatus according to claim 8 wherein the insert is mounted on the reamer.

14. The apparatus according to claim 8 wherein the pilot bit includes a drill head rigid with a lower end of the cam part, the reamer disposed above the drill head and being rotatable relative thereto.

15. The apparatus according to claim 8 wherein the insert body is formed of a harder material than the cam part and reamer body.

16. The apparatus according to claim 8 wherein the rotatable bearing element is formed of a harder material than the cam part and the reamer body.

17. A drilling apparatus for boring in earth and rock formations, comprising:

a pilot bit defining a longitudinal tool axis and including a cam part having a cam axis arranged eccentrically relative to the tool axis; and a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position;

one of the cam part and the reamer body including a plurality of axially spaced rotary bearing elements, the other of the cam part and the reamer including a plurality of axially spaced arcuate grooves in which respective ones of the bearing elements project.

18. A reamer for boring a hole in earth and rock formations, comprising:

a hollow reamer body defining a longitudinal axis and carrying cutting elements at a lower end thereof, a recess formed in an inner periphery of the body and extending downwardly from a top end of the body parallel to the axis, the body having a central bore extending axially therethrough; and an insert removably mounted in the recess and including a projection extending into the center bore, the projection formed of a harder material than a material of which the body is formed;

wherein the insert includes an insert body mounted in the recess, the projection comprising a rotary bearing element mounted for rotation in the insert body.

19. The reamer according to claim 18 wherein there is a vertically spaced pair of the rotary bearing elements mounted for rotation in the insert body.

20. The reamer according to claim 19 wherein the bearing elements comprise ball bearings.

21. A pilot bit for boring a hole in earth and rock formations, comprising:

a lower drill head defining a first axis of rotation and carrying a plurality of cutting elements in a lower face thereof;

a cam part disposed above the lower drill head, the cam part defining a second axis eccentric with respect to the first axis and including, in an outer periphery thereof, an arcuate groove extending circumferentially and being open in a radially outward direction; and an insert removably mounted in the outer periphery of the cam part and extending radially outwardly into the groove to define a circumferential end of the groove, the insert formed of a material harder than the cam part, wherein an outer face of the insert is of spherically concave shape.

22. A drilling apparatus for boring in earth and rock formations, comprising:

a pilot bit defining a longitudinal tool axis and including a cam part having a cam axis arranged eccentrically relative to the tool axis;

a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position; and first and second stop surfaces disposed on the cam part and the reamer body, respectively, and engageable with one another when the reamer body is radially extended, for transmitting rotational cutting forces to the reamer body during a boring operation;

the first and second stop surfaces disposed on respective first and second removable inserts that are removably mounted on the cam part and the reamer body, respectively, the first and second stop surfaces being formed of a material harder than a material from which the cam part and the reamer body are formed;

wherein one of the first and second inserts includes a radial projection forming one of the stop surfaces, the projection comprising a rotatable bearing element.

23. The apparatus according to claim 22 wherein the pilot bit includes a drill head rigid with a lower end of the cam part, the reamer disposed above the drill head and being rotatable relative thereto.

24. A pilot bit for boring a hole in earth and rock formations, comprising:

a lower drill head defining a first axis of rotation and carrying a plurality of cutting elements in a lower face thereof;

a cam part disposed above the lower drill head, the cam part defining a second axis eccentric with respect to the first axis and including, in an outer periphery thereof, an arcuate groove extending circumferentially and being open in a radially outward direction; and an insert removably mounted in the outer periphery of the cam part and extending radially outwardly into the groove to define a circumferential end of the groove, the insert formed of a material harder than the cam part, wherein the insert comprises a plurality of radially extending pins, including axially spaced pins.

25. A drilling apparatus for boring in earth and rock formations, comprising:

a pilot bit defining a longitudinal tool axis and including a cam part having a cam axis arranged eccentrically relative to the tool axis; and a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position;

one of the cam part and the reamer body including a removable insert, the insert including an insert body and a projection mounted within the insert body, the other of the cam part and the reamer including an arcuate groove in which the projection projects, the insert body formed of a harder material than the cam part and the reamer body.

26. The drilling apparatus according to claim 25 wherein the pilot bit includes a drill head rigid with a lower end of the cam part, the reamer disposed above the drill head and being rotatable relative thereto.

27. A drilling apparatus for boring in earth and rock formations, comprising:

a pilot bit defining a longitudinal tool axis and including a cam part having a cam axis arranged eccentrically relative to the tool axis; and a reamer including a hollow reamer body mounted on the cam part for rotation relative thereto about the cam axis, whereby relative rotation in one direction causes the reamer to be radially extended, and relative rotation in an opposite direction causes the reamer to be radially retracted, the reamer body carrying cutting elements for enlarging a hole drilled by the pilot bit when the reamer is in its extended position;

one of the cam part and the reamer body including a recess and a removable insert mounted therein, the insert formed of a harder material than the cam part and the reamer body, the insert, as viewed in a cross section perpendicular to the axis, including a projection projecting out of the recess and into an arcuate groove formed in the other of the cam part and the reamer body, the projection transforming into an integral insert body portion of expanded cross section within the recess.

28. The drilling apparatus according to claim 27 wherein the pilot bit includes a drill head rigid with a lower end of the cam part, the reamer disposed above the drill head and being rotatable relative thereto.

* * * * *